United States Patent [19]

Garrett

[11] 4,254,872

[45] Mar. 10, 1981

[54] PORTABLE MAIL DELIVERY TRAY

[76] Inventor: Donald B. Garrett, 2021 Allendale, Lufkin, Tex. 75901

[21] Appl. No.: 36,870

[22] Filed: May 7, 1979

[51] Int. Cl.[3] ..... B65D 1/36

[52] U.S. Cl. ..... 206/561; 211/73; 220/22; 312/50

[58] Field of Search ..... 206/561, 558, 459, 449, 206/45, 11, 215, 555; 312/50; 211/73; 220/22, 21

[56] References Cited

U.S. PATENT DOCUMENTS

| | | | |
|---|---|---|---|
| 401,638 | 4/1889 | Caughy | 312/50 |
| 1,155,763 | 10/1915 | Shirley | 206/449 |
| 1,495,050 | 5/1924 | Warner | 206/215 |
| 2,020,514 | 11/1935 | Moffitt | 206/449 |
| 2,691,447 | 10/1954 | Schiffer | 206/561 |
| 3,379,316 | 4/1968 | Harrell | 211/73 |
| 3,754,646 | 8/1973 | Henig | 206/45.11 |
| 3,885,668 | 5/1975 | McClain | 206/459 |

*Primary Examiner*—William T. Dixson, Jr.

[57] ABSTRACT

A portable mail delivery tray (10) retains a sorted bundle of mail for quick identification and delivery by a mail carrier from his motor vehicle. The mail delivery tray (10) includes a platform (18) and upwardly extending rear support (20) for supporting a substantially planar inclined support member (22) extending to a front wall (24) extending upwardly from the platform (18). The front wall (24) and a transverse side wall (28) are provided for restraining and aligning the sorted bundle of mail placed upon the support member (22). An elastic member (30) extends from the rear support (20) over the top of the bundle of mail to the front wall (34) for restraining movement of the mail during transit. A receiving station (40) is attached to the transverse side wall (28) for providing a number of compartments for organizing currency and postal items sold by the mail carrier.

6 Claims, 3 Drawing Figures

PORTABLE MAIL DELIVERY TRAY

TECHNICAL FIELD

This invention relates to mail trays for use in containing a bundle of sorted mail, and more particularly to a portable mail delivery tray for use inside the mail delivery vehicle of a rural mail carrier for retaining a bundle of sorted mail in order.

BACKGROUND OF THE INVENTION

The United States Postal Service employs thousands of rural mail carriers to deliver the mail to its patrons residing in rural areas of the country. The rural mail boxes are located by the side of the road so that the rural mail carrier may make his deliveries while remaining seated in his motor vehicle. In addition to delivering mail, the rural mail carrier also picks up the mail a patron has left in the mail box as well as selling stamps and money orders. The rural main carrier has only a small area adjacent to him in his motor vehicle to organize all these items in such a fashion that he can handle all mail transactions efficiently from the driver's seat of his vehicle.

Many rural mail carriers presently place all these items on the passenger side of the vehicle's seat, while others rely on a number of separate containers, such as cardboard boxes or the like, to segregate and organize the mail and other items handled by the mail carrier. In either event, the sorted mail to be delivered is normally tied into separate bundles to retain them in the correct order. In placing an untied bundle of mail in a container for delivery, the envelopes often get out of the original sorted order because of the movement of the vehicle and the items must be repositioned at each stop so that the mail carrier may check the addressee on each envelope. A need has thus arisen for a mail delivery tray for use by rural mail carriers which is portable and can be placed on the driver's seat while the mail carrier is making his rounds.

SUMMARY OF THE INVENTION

In accordance with a preferred embodiment of the invention, a platform dimensioned to fit on a passenger seat of an automobile includes an upwardly extending rear wall. The rear wall supports the upper edge of a substantially planar inclined member sloping downwardly towards the front edge of the tray, oriented to the front of the vehicle. A front wall extends upwardly from the platform and a side member extends transversely along the side of the inclined member. A bundle of sorted mail items is aligned on the inclined member with the front wall and transverse wall positioned for aligning the mail. The mail items are sorted such that the driver may see at a glance from the driver's seat the address of the first to be delivered mail items at the top of the inclined stack proximate the rear seat with the last to be delivered mail items next to the front wall. A restraining means extending from the rear wall to the front wall is attachable over the top of the bundle of sorted mail items to retain them in proper order during movement of the vehicle.

In addition, a number of compartments are attached to the transverse member of the main delivery tray, said compartments being partitioned and dimensioned to hold stardard size envelopes, stamps, money orders and change.

In an alternate embodiment of the present invention, the compartments may be left off the mail delivery tray to provide a more compact, lighter weight portable mail delivery tray.

A better understanding of the invention and its advantages can be seen in the following description of the figures and preferred embodiment.

DESCRIPTION OF THE PREFERRED EMBODIMENT

Figure 1:
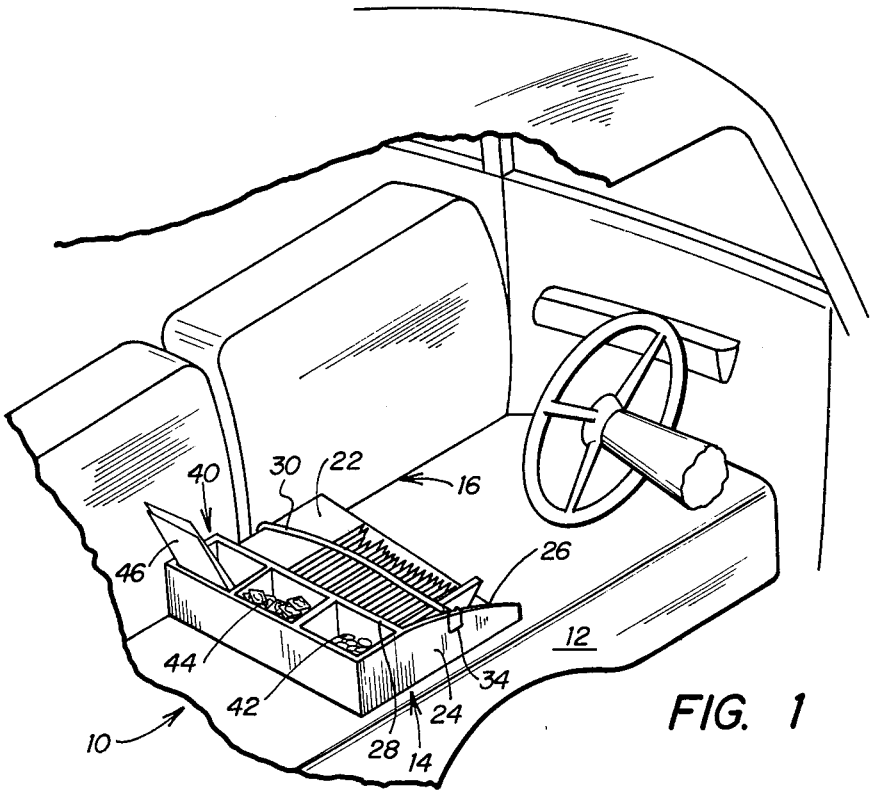
FIG. 1 is a perspective view of a portable mail delivery tray positioned on the front seat of a motor vehicle operated by a rural main carrier.

A portable mail delivery tray of the present invention is illustrated in FIG. 1 and generally identified by the reference numeral 10. The tray 10 is illustrated in one position upon the front seat 12 of an automobile operated by a rural main carrier. Of course, the mail tray 10 may be positioned in any orientation desired by main carrier, e.g., the tray 10 may be positioned so that the receiving station 40 is positioned adjacent the rear of the passenger seat 12. The mail delivery tray 10 is dimensioned to fit between the front edge 14 and the rear edge 16 of the seat 12. The tray 10 may also be dimensioned to fit the space adjacent the driver's seat of any type of vehicle used by the rural mail carrier, and it may be constructed of lightweight ABS plastic.

Figure 2:
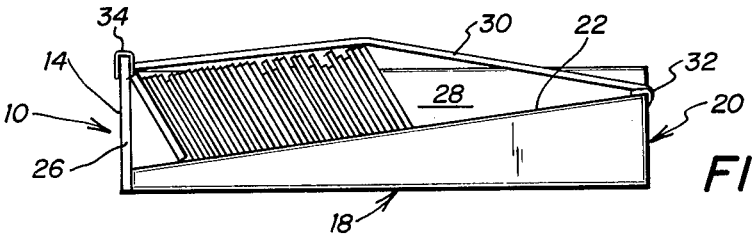
FIG. 2 is a side view of the portable mail delivery tray of FIG. 1, as seen from the driver's side of the vehicle.
Figure 3:
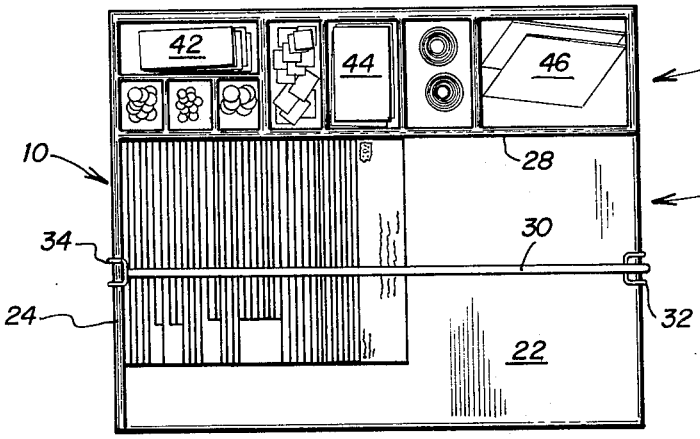
FIG. 3 is a plan view of the portable mail delivery tray of FIG. 1.

As illustrated in FIGS. 1–3, the mail delivery tray 10 includes a platform 18 for resting upon the passenger seat 12 of the vehicle. A rear support 20 extends upwardly from the platform 18 to elevate an inclined support member 22 extending from the rear support 20 and sloping downwardly towards a front wall 24. As best illustrated in FIG. 1, the front wall 24 includes a recessed upper portion 26 sloping downwardly towards the edge of the tray 10 facing the driver's side to provide easy access to the letters or other articles of mail supported on the tray 10. The upwardly extending front wall 24 is of a sufficient height to extend above the width of a standard envelope. A side wall 28 extends upwardly from the platform 18 generally normal to the front wall 24 along the side of the inclined support member 22 distal from the driver's side of the vehicle, as the tray 10 is shown positioned on front seat 12 of FIG. 1. The side wall 28 provides a means for aligning the edge of a sorted bundle of main placed on the support member 22.

Finally, an elastic member 30 is attached by a clip 32 to the rear support 20 and is releasably attached with a clip 34 hooked over the top of the front wall 24. An inclined support plate 36 extends between the front edge of the inclined support member 22 and the front wall 24 to position the envelopes at an angle so that the addresses may be easily recognized by the mail carrier. Of course, alternate restraining means may be substituted for the elastic member 30, such as a spring.

The embodiment of the portable main delivery tray 10 illustrated in FIGS. 1–3 includes a compartmentalized receiving station 40. The receiving station 40 includes compartments 42, 44, and 46 for segregating and organizing the various items received in transactions with the rural postal patrons. The first compartment 42 is provided for holding the cash receipts received from the postal patrons in exchange for stamps or money orders. The first compartment 42 is provided to organize loose change and folding money necessary for selling stamps and money orders. The second compartment 44 is further partitioned for organizing money orders and various denominations of stamps. Finally, compartment 46 is provided for receiving and segregating the mail picked up by the rural mail carrier. Of course, such additional compartments and partitions may be included as required to segregate and organize items received from the rural postal patron or the items to be sold to said patrons.

An alternate embodiment of the portable mail delivery tray 10, the receiving station 40, may be eliminate to reduce the size and weight of the tray 10.

In use, the portable mail delivery tray 10 could be picked up at the post office by the rural mail carrier, where the mail is sorted and bundled. One or more of the sorted bundles may then be placed on the portable mail delivery tray 10, arranged with the first to be delivery letter at the top of the bundle and the last delivery letter on the bottom of the bundle positioned against the inclined support plate 36. The elastic member 30 is then stretched across the top of the bundle and secured to the front wall 24 by means of the clip 34. The bundle of sorted mail is now aligned and securely retained in order upon the tray until each item is removed separately for delivery.

The portable mail delivery tray 10 may be placed on the front seat 12 of the vehicle next to the mail carrier with the side wall 28 farthest away from the carrier. The carrier may determine the address for the next delivery from the driver's seat of the automobile by looking at the top envelope and removing all main items for that postal patron by sliding them out from under the elastic member 30. Elastic member 30 adjusts to the size and shape of the bundle as additional mail items are removed from the bundle in order to retain the mail in the proper order upon the mail tray 10. As described above, the mail tray 10 may be oriented on the seat 12 to facilitate the delivery of the mail. In the orientation where the receiving station 40 abuts the back of the seat 12, the mail may be withdrawn by sliding it forward towards the front of the vehicle.

Letters placed in the rural mail boxes for pickup may be segregated from the outer mail by placing them in the compartment 46. Similarly, sale of money orders and stamps may be made by utilizing the compartments 42 and 44 for organizing the stamps, money orders and currency.

While a particular embodiment of this invention has been shown and described above, it is obvious that changes and modifications can be made without departing from the true spirit and scope of the invention. It is the intention of the appended claims to cover all such changes and modifications.

I claim:

1. The portable mail delivery tray for retaining a sorted bundle of main upon the passenger seat of a motor vehicle operated by a mail carrier for rapid identification and delivery of the mail, comprising:

a rigid platform for supporting the tray upon the passenger seat of a vehicle;

a rear support means extending upwardly from said platform;

a substantially planar inclined member supported upon and sloping downwardly from said rear support means to the front edge of said platform;

a front wall extending upwardly from the front edge of said platform, said front wall being substantially perpendicular to the front edge of said platform;

a side wall extending transversely along one side of said inclined support member, said side wall being perpendicular to said inclined support member; and a restraining means attachable from the rear support means to the front wall for retaining a sorted bundle of mail upon the inclined support member, whereby the mail carrier may withdraw the next to be delivered article of mail from the bundle while said restraining means keeps the remaining articles of mail in their sorted order.

2. The portable mail delivery tray of claim 1, and further comprising an inclined support member attached to said front wall for supporting the articles of the sorted bundle of mail at an angle, whereby the mail carrier may view the next to be delivered item of mail on said inclined support member.

3. The portable mail delivery tray of claim 1, wherein said restraining means is an elastic member fixed at one end to said rear support means and said elastic member is releasably secured to said front wall.

4. The portable mail delivery tray of claim 1, wherein said front wall includes a downwardly sloping upper edge for providing access to the last mail items supported on the mail tray.

5. The portable mail delivery tray of claim 1 and further comprising:

a compartmentalized receiving station attached to said transverse side wall for segregating and organizing mail items received by a rural mail carrier.

6. The portable mail delivery tray of claim 1 wherein said restraining means is a spring tensioning member secured at one end to said rear support means and extending to and releasably securable to said front wall.

* * * * *

UNITED STATES PATENT AND TRADEMARK OFFICE

CERTIFICATE OF CORRECTION

PATENT NO. : 4,254,872

DATED : March 10, 1981

INVENTOR(S) : Donald B. Garrett

It is certified that error appears in the above-identified patent and that said Letters Patent are hereby corrected as shown below:

Column 1, line 21, change "main" to --mail--.

Column 1, line 65, change "main" to --mail--.
Column 2, line 13, change "main" to --mail--.
Column 2, line 23, change "main" to --mail--.
Column 2, line 24, change "main" to --mail--.
Column 2, line 51, change "main" to --mail--.
Column 2, line 62, change "main" to --mail--.
Column 3, line 14, change "eliminate" to --eliminated--.
Column 3, line 20-21, change "delivery" to --delivered--.
Column 3, line 21, change "delivery" to --delivered--.
Column 3, line 34, change "main" to --mail--.
Column 3, line 46, change "outer" to --other--.
Column 4, line 6, change "main" to --mail--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*